US009708090B2

(12) United States Patent
Yu et al.

(10) Patent No.: US 9,708,090 B2
(45) Date of Patent: Jul. 18, 2017

(54) ADJUSTING APPARATUS

(71) Applicants: SHENZHEN FUTAIHONG PRECISION INDUSTRY CO., LTD., Shenzhen (CN); FIH (Hong Kong) Limited, Kowloon (HK)

(72) Inventors: Bing Yu, Shenzhen (CN); Jian-Ping Jin, Shenzhen (CN); Zhi-Jin Ma, Shenzhen (CN); Yong-Fu Hu, Shenzhen (CN)

(73) Assignees: SHENZHEN FUTAIHONG PRECISION INDUSTRY CO., LTD., Shenzhen (CN); FIH (HONG KONG) LIMITED, Kowloon (HK)

( * ) Notice: Subject to any disclaimer, the term of this patent is extended or adjusted under 35 U.S.C. 154(b) by 206 days.

(21) Appl. No.: 14/488,574

(22) Filed: Sep. 17, 2014

(65) Prior Publication Data

US 2015/0074965 A1 Mar. 19, 2015

(30) Foreign Application Priority Data

Sep. 18, 2013 (CN) ..... 2013 1 0424504

(51) Int. Cl.
*B21D 39/04* (2006.01)
*B65C 7/00* (2006.01)

(52) U.S. Cl.
CPC ..... *B65C 7/00* (2013.01); *Y10T 29/5397* (2015.01)

(58) Field of Classification Search
USPC ..... 29/281.3
See application file for complete search history.

(56) References Cited

U.S. PATENT DOCUMENTS 4,132,583 A * 1/1979 Hodgson ..... B65C 9/1884 156/351
4,189,337 A * 2/1980 Higgins ..... B65C 9/1884 156/351
4,255,220 A * 3/1981 Kucheck ..... B65C 9/1884 156/249
4,367,118 A * 1/1983 Karp ..... B65C 9/1884 156/497
4,595,447 A * 6/1986 Lindstrom ..... B65C 9/1884 156/364
5,254,189 A * 10/1993 Hirobe ..... B65C 1/021 156/360
5,300,181 A * 4/1994 Yamaguchi ..... B65C 1/042 156/542
5,304,264 A * 4/1994 Wehrmann ..... B65C 9/0006 156/361

(Continued)

FOREIGN PATENT DOCUMENTS

CN 202481414 U 10/2012

*Primary Examiner* — Alvin Grant
(74) *Attorney, Agent, or Firm* — Zhigang Ma

(57) ABSTRACT

An adjusting apparatus is mounted to a tags pasting device and is for adjusting a position of a tag. The adjusting apparatus includes a cylinder assembly and a holder assembly. The cylinder assembly includes a cylinder and an absorber, the absorber is coupled to the cylinder and is for absorbing a tag. The holder assembly is coupled to the cylinder and includes two elastic pieces. The cylinder drives the absorber to engage with the two elastic pieces, thereby the two elastic pieces aligning with the tag on the absorber.

17 Claims, 5 Drawing Sheets

(56) References Cited

U.S. PATENT DOCUMENTS

| | | | | |
|---|---|---|---|---|
| 5,370,754 | A * | 12/1994 | Soloman | B65C 1/045 156/361 |
| 5,853,530 | A * | 12/1998 | Allen | B65C 1/021 156/541 |
| 6,440,249 | B1 | 8/2002 | Swinburne | |
| 6,619,361 | B1 * | 9/2003 | Swinburne | B65C 9/1869 156/362 |
| 6,691,496 | B2 * | 2/2004 | Pena | G09F 3/04 156/277 |
| 6,978,818 | B1 | 12/2005 | Vicktorius et al. | |
| 7,093,641 | B2 * | 8/2006 | Sharp | B65H 35/0013 156/353 |
| 7,147,028 | B2 * | 12/2006 | Denholm | B65C 9/1803 156/356 |
| 7,374,625 | B2 * | 5/2008 | Panetta | B65H 35/0013 156/250 |

* cited by examiner

ADJUSTING APPARATUS

FIELD

The present disclosure relates to an adjusting apparatus, and particularly relates to an adjusting apparatus for automatically adjusting tags position.

BACKGROUND

Products need to be pasted with tags after manufactured for being identified. A tags pasting device is used to paste the tags on the products. However, the tags may not be pasted on an exact position because of some errors, operators need to manually adjust the tags to the exact position at the moment. Hence, operators may spend a great time on adjusting the errors and has a low working efficiency.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
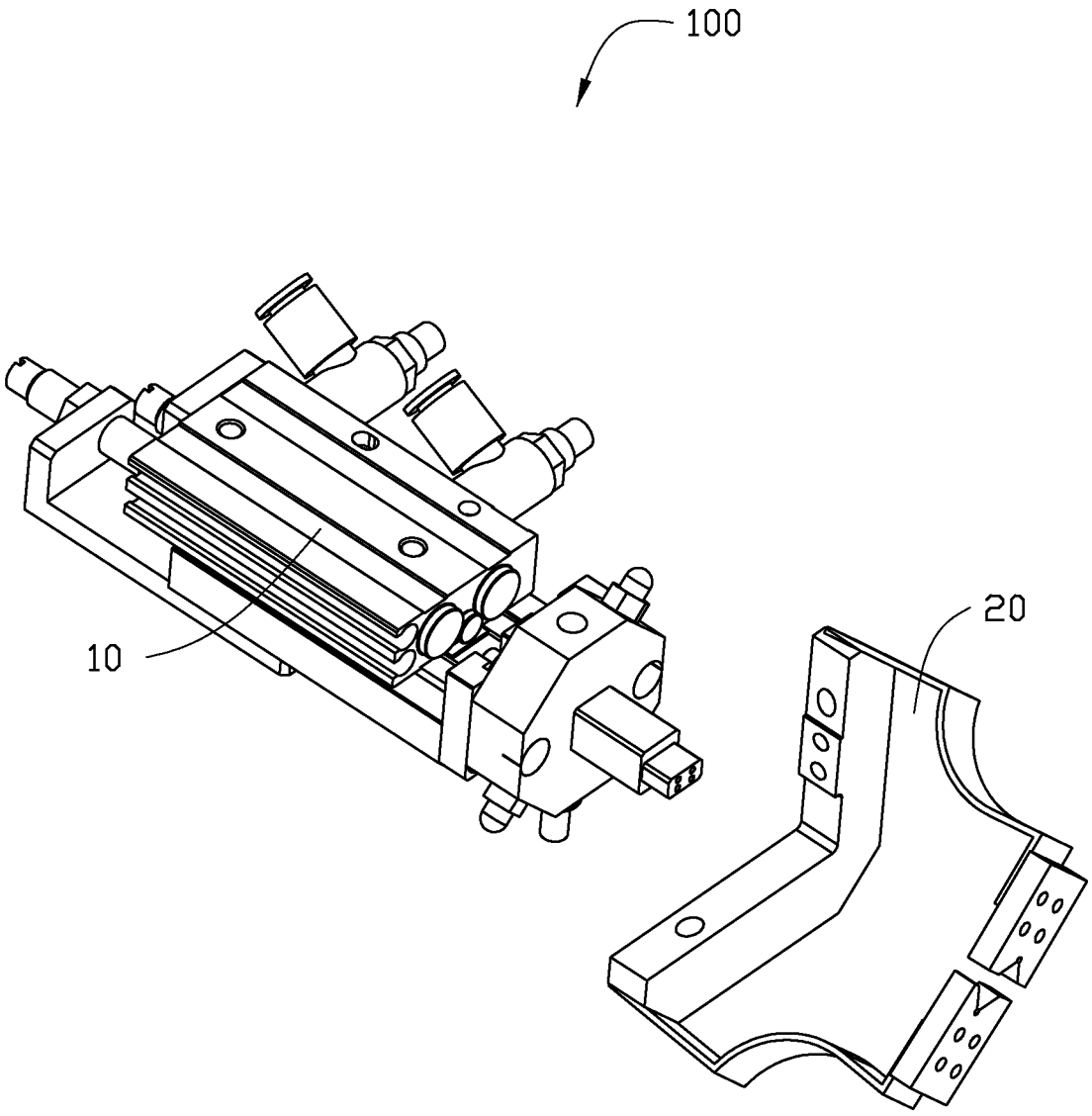
FIG. 1 is a partial exploded view of an exemplary embodiment of an adjusting apparatus.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

FIG. 1 illustrates an exemplary embodiment of an adjusting apparatus 100. The adjusting apparatus 100 is used for adjusting positions of tags on the products. The adjusting apparatus 100 includes a cylinder assembly 10 and a holder assembly 20. The cylinder assembly 10 is mounted to a tags pasting device (not shown) and is used for absorbing and driving tags. The holder assembly 20 is coupled to the cylinder assembly 10 and is used to adjust a position of the tag on the cylinder assembly 10.

Figure 2:
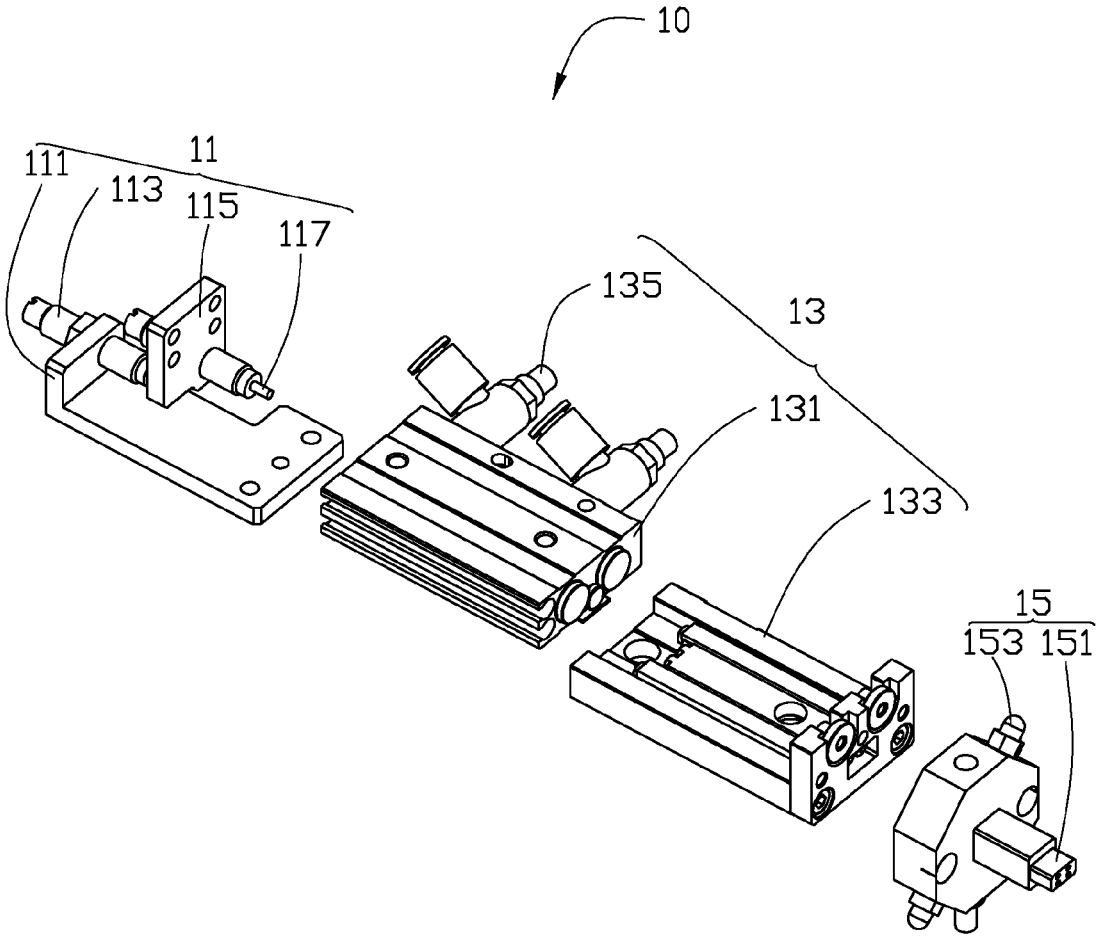
FIG. 2 is an exploded view of a cylinder assembly of the adjusting apparatus of FIG. 1.

Referring to FIG. 2, the cylinder assembly 10 includes a buffer 11, a cylinder 13, and an absorber 15. The buffer 11 is coupled to the tags pasting device. The buffer 11 includes a first coupling board 111, a first buffering piece 113, a second coupling board 115, and a second buffering piece 117. The first coupling board 111 and the second coupling board 115 are coupled to the tags pasting device. The first buffering piece 113 is inserted through the first coupling board 111 and the second buffering piece 117 is inserted through the second coupling board 115. The first buffering piece 113 and the second buffering piece 117 are used to buffer movements of the cylinder 13.

The cylinder 13 includes a main body 131, a sliding piece 133, and two gas valves 135. The main body 131 is coupled to the second coupling board 115. The two gas valves 135 are mounted on the main body 131 and spaced from each other. The sliding piece 133 is slidably coupled to and is communicated with the main body 131, thus gas can be transmitted from the gas valves 135 and the main body 131 to the sliding piece 133. Therefore, when the gas valves 135 are open, the gas can be transmitted to the sliding piece 133 and thereby driving the sliding piece 133 slide relative to the main body 131; when the gas valves 135 are closed, no gas continually driving the sliding piece 133 and thereby the sliding piece 133 can reposition.

The absorber 15 is mounted to an end of the sliding piece 133 and thereby moving together with the sliding piece 133. The absorber 15 includes a head 151 and two resisting posts 153. The head 151 may connect to an external gas pipe (not shown), the external gas pipe provides suction power to the head 151 to absorb tags. The two resisting posts 153 are symmetrically arranged on opposite sides of the head 151 for being resisted to the holder assembly.

Figure 3:
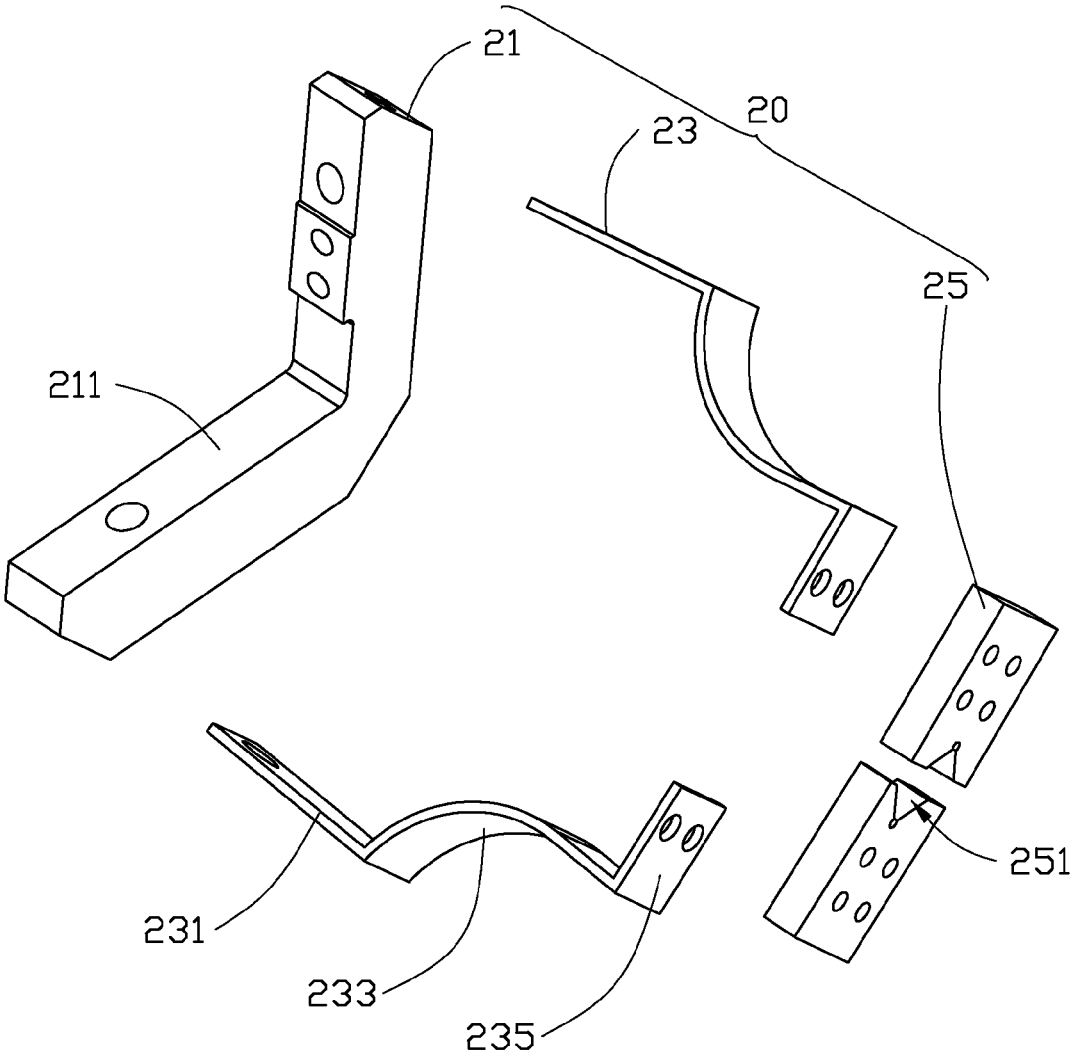
FIG. 3 is an exploded view of a holder assembly of the adjusting apparatus of FIG. 1.

FIG. 3 illustrates an exploded view of a holder assembly 20. The holder assembly 20 includes a mounting board 21, two elastic pieces 23, and two latching pieces 25. The mounting board 21 is mounted to the main body 131. The mounting board 21 is substantially an L-shaped and includes two connected side plates 211.

The two elastic pieces 23 are mounted to the two side plates 211. In one embodiment, each elastic piece 23 is made by bent elastic metal piece. Each elastic piece 23 includes a connecting portion 231, an arcuate portion 233, and a mounting portion 235 connected in that order. The connecting portion 231 connects to the side plate 211. The arcuate portion 233 is connected between the connecting portion 231 and the mounting portion 235. The arcuate portion 233 is engaged with the resisting post 153 to drive the elastic piece 23. The mounting portion 235 is substantially perpendicular to the connecting portion 231. A distance between the two connecting portions 231 is greater than a distance between the two mounting portions 235, and a distance between the two arcuate portions 233 becomes smaller from an end connecting the connecting portion 231 towards the other end connecting the mounting portion 235.

The two latching pieces 25 are mounted to the mounting portions 235, respectively. Each latching piece 25 defines a latching space 251 on one end for enclosing a space for the head 151. In one embodiment, the latching space 251 is substantially a triangle shaped. In other embodiments, a shape of the latching space 251 can be designed according to a shape of the tags, thus to firmly close to the tags.

Figure 4:
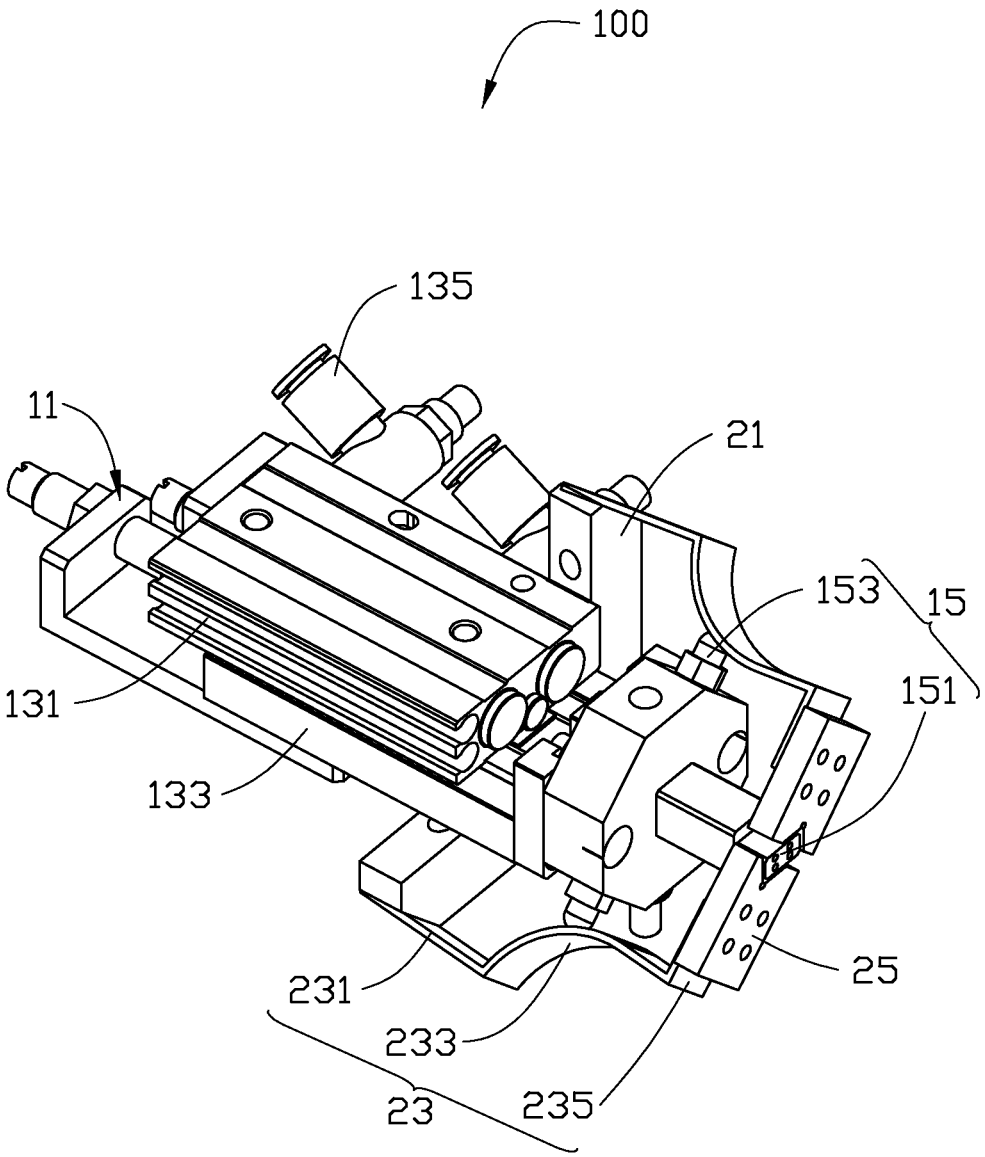
FIG. 4 is an isometric view of a starting state of the adjusting apparatus.

FIG. 4 illustrates an assembled view of the adjusting apparatus 100. In assembly, the buffer 11 is mounted to the tags pasting device via crews (not shown); the absorber 15 is mounted to the sliding piece 133; the mounting board 21 is mounted to the main body 131; the two elastic pieces 23 are mounted to the mounting board 21; each elastic piece 23 carries a latching piece. The absorber 15 is located between the two elastic pieces 23, the two resisting posts 153 resist against the arcuate portions 233, respectively. The head 151 is enclosed by latching spaces 251.

Figure 5:
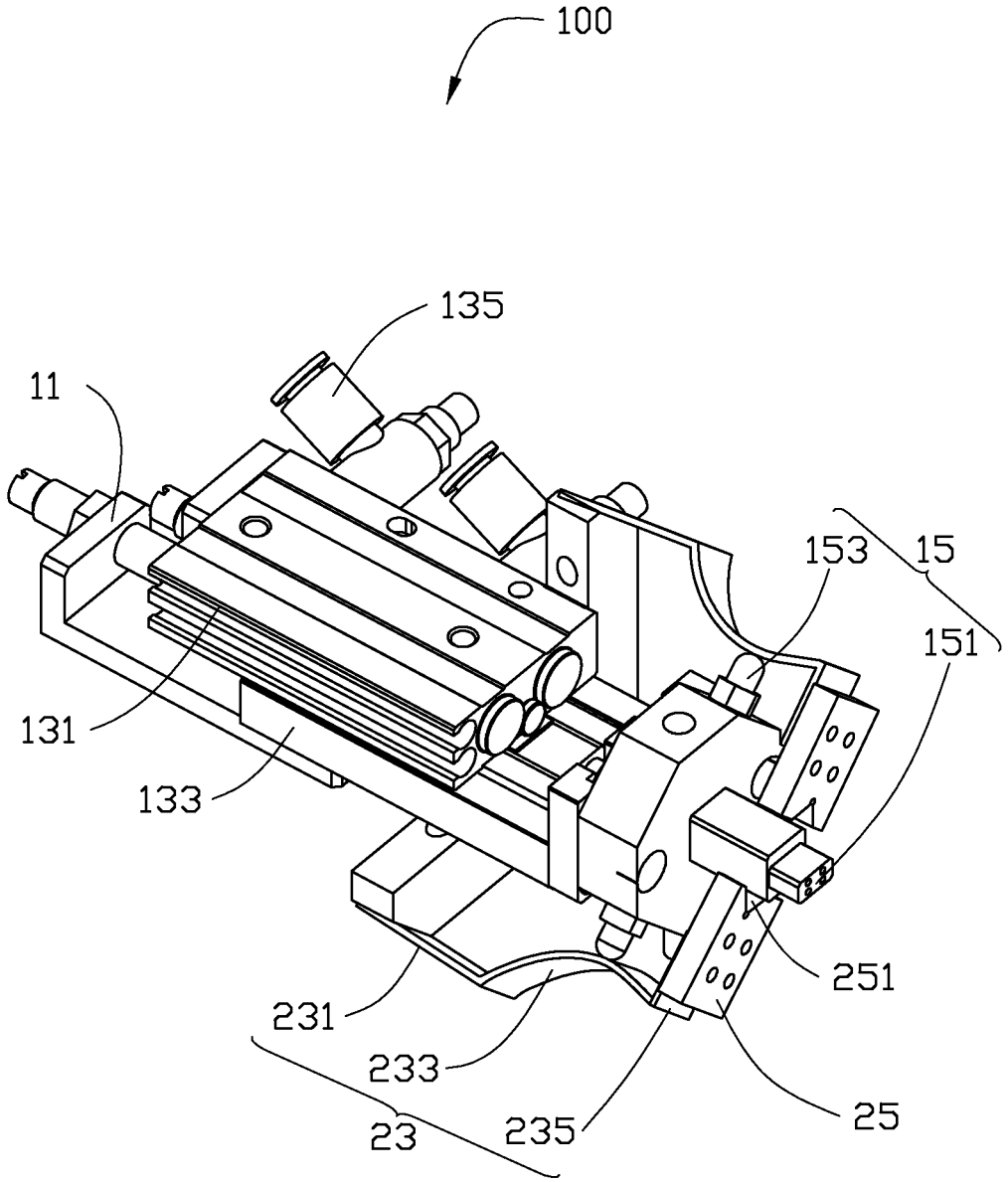
FIG. 5 is an isometric view of an operating state of the adjusting apparatus.

FIG. 5 illustrates an operating state of the adjusting apparatus 100. Firstly starting the tags pasting device, the gas valves 135 open to let gas coming in, and then the sliding piece 133 slides related to the main body 131 and drives the absorber 15. At this time, the resisting posts 153 move along the arcuate portions 233 and towards the latching pieces 25. The resisting posts 153 resist against the arcuate portions 233 and force the arcuate portions 233 extend outwardly from each other when moving closer to the latching pieces 25, thereby a distance between the two latching piece 25 become larger. Therefore, the head 151 passes through the latching spaces 251 and absorbs a tag (not shown). After absorbing the tag, the gas valves 135 exhaust gas, the sliding piece 131 slides together with the absorber 15 towards the main body 131, the resisting posts 153 slide along the arcuate portions 233 and towards the mounting board 21, thereby the distance between the two arcuate portions 233 become larger because closer to the mounting board 21, thus the two arcuate portions 233 restore towards each other. Therefore, the two latching pieces 25 move towards each other and push the tag on the head 151 to be received in the latching space 251, thus, the position of the tag can be adjusted.

In other embodiments, a size of the latching space 251 can be adjusted according to different sizes of the tags.

In other embodiments, the latching pieces 25 can be omitted, the mounting portions 235 can be used to adjust the tags on the head 151.

The adjusting apparatus 100 is coupled to the tags pasting device, using the cylinder 13 to automatically drive the elastic pieces 23 and the absorber 15, and using the elastic pieces 23 to drive the latching pieces 25 to enclose the head 151 of the absorber 15, thereby adjusting a position of the tag on the head 151. The adjusting apparatus 100 is operated automatically and has a greater efficiency.

It is believed that the embodiments and their advantages will be understood from the foregoing description, and it will be apparent that various changes may be made thereto without departing from the scope of the disclosure or sacrificing all of its advantages, the examples hereinbefore described merely being illustrative embodiments of the disclosure.

What is claimed is:

1. An adjusting apparatus, the adjusting apparatus configured for adjusting a position of a tag, the adjusting apparatus comprising:

a cylinder assembly; the cylinder assembly comprising a cylinder and an absorber, wherein the absorber is coupled to the cylinder and absorbs the tag; and a holder assembly; the holder assembly is coupled to the cylinder and comprises two elastic pieces and two latching pieces mounted to the two elastic pieces, each latching piece defining a latching space that substantially corresponds to a shape of the tag; and wherein to absorb the tag, the cylinder drives the absorber to resist against the elastic pieces and force the two latching pieces to move apart from each other to allow the absorber to pass through the latching space and absorb the tag;

wherein after absorbing the tag, the cylinder drives the absorber to engage with the elastic pieces so that the two latching pieces move toward each other to enclose the tag in the latching space, thereby adjusting the position of the tag.

2. The adjusting apparatus of claim 1, wherein the absorber further comprises a head and two resisting posts arranged on opposite sides of the head, the head absorbs the tag, and the two resisting posts resist against the two elastic pieces, respectively.

3. The adjusting apparatus of claim 2, wherein each elastic piece comprises a connecting portion, an arcuate portion, and a mounting portion, the arcuate portion connects between the connecting portion and the mounting portion, and the two arcuate portions, each corresponding to one of the two elastic pieces, extend towards each other from the connecting portion to the mounting portion, whereby a distance between two first ends of the two elastic pieces connecting the connecting portion is greater than a distance between two second ends connecting the mounting portion.

4. The adjusting apparatus of claim 3, wherein the cylinder comprises a main body, a sliding piece, and at least one gas valve, the sliding piece is slidably coupled to the main body, the absorber is mounted to the sliding piece, and the gas valve is mounted on the main body and transmits gas to drive the sliding piece to slide along the main body.

5. The adjusting apparatus of claim 4, wherein when the gas valve opens to let gas enter, the sliding piece slides relative to the main body and drives the absorber, the resisting posts move along the arcuate portions and towards the latching pieces, the resisting posts resist against the arcuate portions and force the arcuate portions to extend outwardly from each other when moving closer to the latching pieces, thereby increasing a distance between the two latching pieces to allow the head to pass through the latching space and absorb the tag.

6. The adjusting apparatus of claim 5, wherein after absorbing the tag, the gas valves exhaust gas, the sliding piece slides together with the absorber towards the main body, the resisting posts slide along the arcuate portions and towards the mounting board, thereby increasing the distance between the two arcuate portions as the resisting posts become closer to the mounting boards, thus the two arcuate portions restore towards each other, and the two latching pieces move towards each other to push the tag on the head to be received in the latching space, thereby adjusting the position of the tag.

7. The adjusting apparatus of claim 4, wherein the holder assembly further comprises a mounting board, the mounting board is mounted to the main body, the mounting board is substantially L-shaped and comprises two connected side plates respectively connected to the two elastic pieces.

8. The adjusting apparatus of claim 1, wherein the cylinder assembly further comprises a buffer, the buffer comprises a first coupling board, a first buffering piece, a second coupling board, and a second buffering piece, the first buffering piece is inserted through the first coupling board and the second buffering piece is inserted through the second coupling board, the first buffering piece and the second buffering piece are used to buffer movements of the cylinder.

9. The adjusting apparatus of claim 1, wherein each elastic piece comprises a bent elastic metal piece.

10. An adjusting apparatus, the adjusting apparatus configured for adjusting a position of a tag, the adjusting apparatus comprising:

a cylinder; the cylinder comprising a main body and a sliding piece, wherein the sliding piece slidably couples to the main body;

an absorber; the absorber is coupled to the sliding piece and absorbs the tag, the absorber further comprising a head and two resisting posts arranged on opposite sides of the head;

two elastic pieces coupled to the main body; and two latching pieces coupled to the two elastic pieces, each latching piece defining a latching space;

wherein to absorb the tag, the sliding piece drives the two resisting posts to resist against the two elastic pieces, thereby driving the two latching pieces outwardly from one another to allow the head to pass through the latching space and absorb the tag, after absorbing the tag, the sliding piece retracts to position the two latching pieces toward one another to enclose the tag in the latching space and adjust the position of the tag on the absorber.

11. The adjusting apparatus of claim 10, wherein each elastic piece comprises a connecting portion, an arcuate portion, and a mounting portion, the arcuate portion connects between the connecting portion and the mounting portion, and the two arcuate portions, each corresponding to one of the two elastic pieces, extend towards each other from the connecting portion to the mounting portion, thereby a distance between two first ends of the two elastic pieces connecting the connecting portion is greater than a distance between two second ends connecting the mounting portion.

12. The adjusting apparatus of claim 11, wherein the cylinder further comprises at least one gas valve, the gas valve is mounted on the main body and transmits gas to drive the sliding piece to slide along the main body.

13. The adjusting apparatus of claim 12, wherein when the gas valve opens to let gas enter, and then the sliding piece slides relative to the main body and drives the absorber, the resisting posts move along the arcuate portions and towards the latching pieces, the resisting posts resist against the arcuate portions and force the arcuate portions to extend outwardly from each other when moving closer to the latching pieces, thereby increasing a distance between the two latching pieces to allow the head to pass through the latching spaces and absorbs the tag.

14. The adjusting apparatus of claim 13, wherein after absorbing the tag, the gas valves exhaust gas, the sliding piece slides together with the absorber towards the main body, the resisting posts slide along the arcuate portions and towards the mounting board, thereby increasing the distance between the two arcuate portions as the resisting posts become closer to the mounting boards, thus the two arcuate portions restore towards each other, the two latching pieces move towards each other and push the tag on the head to be received in the latching space, thus to adjust the position of the tag.

15. The adjusting apparatus of claim 12, wherein the holder assembly further comprises a mounting board, the mounting board is mounted to the main body, the mounting board is substantially L-shaped and comprises two connected side plates respectively connected to the two elastic pieces.

16. The adjusting apparatus of claim 10, wherein the cylinder assembly further comprises a buffer, the buffer comprises a first coupling board, a first buffering piece, a second coupling board, and a second buffering piece, the first buffering piece is inserted through the first coupling board and the second buffering piece is inserted through the second coupling board, the first buffering piece and the second buffering piece are used to buffer movements of the cylinder.

17. The adjusting apparatus of claim 10, wherein each elastic piece comprises a bent elastic metal piece.

* * * * *